US008827937B2

(12) United States Patent
Giguére

(10) Patent No.: US 8,827,937 B2
(45) Date of Patent: Sep. 9, 2014

(54) MASSAGING DEVICE

(75) Inventor: Martial Giguére, Ste-Marie-de-Beauce (CA)

(73) Assignee: Les Entreprises Airbrass Inc., Sainte-Marie-de-Beauce, Quebec (CA)

( * ) Notice: Subject to any disclaimer, the term of this patent is extended or adjusted under 35 U.S.C. 154(b) by 1135 days.

(21) Appl. No.: 11/773,777

(22) Filed: Jul. 5, 2007

(65) Prior Publication Data

US 2008/0058686 A1 Mar. 6, 2008

Related U.S. Application Data

(60) Provisional application No. 60/841,199, filed on Aug. 31, 2006.

(51) Int. Cl.

| | |
|---|---|
| ***A61H 1/00*** | (2006.01) |
| ***A61H 23/02*** | (2006.01) |
| ***A61H 33/00*** | (2006.01) |
| ***A61H 7/00*** | (2006.01) |

(52) U.S. Cl.

CPC .... *A61H 23/0263* (2013.01); *A61H 2201/0111* (2013.01); *A61H 33/00* (2013.01); *A61H 2201/5023* (2013.01); *A61H 33/6089* (2013.01); *A61H 7/001* (2013.01)

USPC ..... 601/65; 601/46; 601/67; 601/70

(58) Field of Classification Search

USPC ..... 601/15, 17, 18, 46–49, 55, 57, 61, 64, 601/65, 70, 67; 4/574.1, 622, 559, 546

See application file for complete search history.

(56) References Cited

U.S. PATENT DOCUMENTS

| | | | | |
|---|---|---|---|---|
| 3,881,471 | A * | 5/1975 | Grube | 601/158 |
| 4,249,522 | A | 2/1981 | Carrier | |
| 4,935,972 | A | 6/1990 | Brady | |
| 5,418,984 | A | 5/1995 | Livingston, Jr. | |
| 5,738,638 | A | 4/1998 | Henkin et al. | |
| 5,930,851 | A | 8/1999 | Brunelle | |
| 6,149,611 | A * | 11/2000 | Chen | 601/22 |
| 6,355,009 | B1 | 3/2002 | Henkin et al. | |
| 6,387,063 | B1 * | 5/2002 | Elnar | 601/99 |
| 6,511,446 | B1 * | 1/2003 | Wu | 601/15 |
| 7,276,034 | B1 * | 10/2007 | Elnar | 601/55 |
| 2004/0002666 | A1 * | 1/2004 | Chen | 601/17 |
| 2004/0153011 | A1 * | 8/2004 | Noguchi et al. | 601/17 |
| 2005/0075589 | A1 * | 4/2005 | Friedland | 601/72 |
| 2006/0009719 | A1 * | 1/2006 | LaJoie et al. | 601/70 |
| 2007/0136943 | A1 * | 6/2007 | Long | 4/622 |

FOREIGN PATENT DOCUMENTS

| | | | |
|---|---|---|---|
| CA | 2503537 | | 5/2004 |
| DE | 3243428 | A1 * | 5/1984 |
| DE | 197 06 363 | | 8/1998 |
| EP | 1 570 827 | | 9/2005 |

* cited by examiner

*Primary Examiner* — Valerie L Skorupa
(74) *Attorney, Agent, or Firm* — Robert Brouillette

(57) ABSTRACT

A massaging device to be mounted in a hole of an inner wall of a bath, having a casing mountable in a watertight manner in the hole, a flexible member mounted in a watertight manner on the casing, the flexible member having a surface accessible to a user in the bath when the massaging device is mounted in the bath and an electrically operated vibrator mounted inside the casing, for vibrating the flexible member. A bath massaging system having massaging devices as described above.

25 Claims, 13 Drawing Sheets

MASSAGING DEVICE

FIELD OF THE INVENTION

The present invention relates to a massaging device to be mounted in a hole of an inner wall of a bath.

BACKGROUND OF THE INVENTION

It is known in the art that bath massaging systems are often made with water or air jets. These systems need noisy pumps and pipes which, in some case, can accumulate bacteria. Furthermore, water or air jets can be uncomfortable for people having a sensitive skin.

Thus, there is a need for a bath massaging system that is more hygienic, quieter and that provides a new kind of massage.

SUMMARY OF THE INVENTION

The object of the present invention is to provide a system that satisfies the above-mentioned needs.

More particularly, the present invention is directed to a massaging device to be mounted in a hole of an inner wall of a bath, comprising:

- a casing mountable in a watertight manner in the hole;
- a flexible member mounted in a watertight manner on the casing, the flexible member having a surface accessible to a user in the bath when the massaging device is mounted in the bath; and
- an electrically operated vibrator mounted inside the casing, for vibrating the flexible member.

The present invention is also directed to a bath massaging system comprising:

- at least one massaging device to be mounted in a hole of an inner wall of a bath, each massaging device comprising:
  - a casing mountable in a watertight manner in the hole;
  - a flexible member mounted in a watertight manner on the casing, the flexible member having a surface accessible to a user in the bath when the massaging device is mounted in the bath; and
  - an electrically operated vibrator mounted inside the casing, for vibrating the flexible member.

The objects, advantages or other features of the present invention will become more apparent upon reading of the following non-restrictive description of a preferred embodiment thereof, given for the purpose of exemplification only, with reference to the accompanying drawing.

DETAILED DESCRIPTION OF PREFERRED EMBODIMENTS OF THE INVENTION

Figure 1:
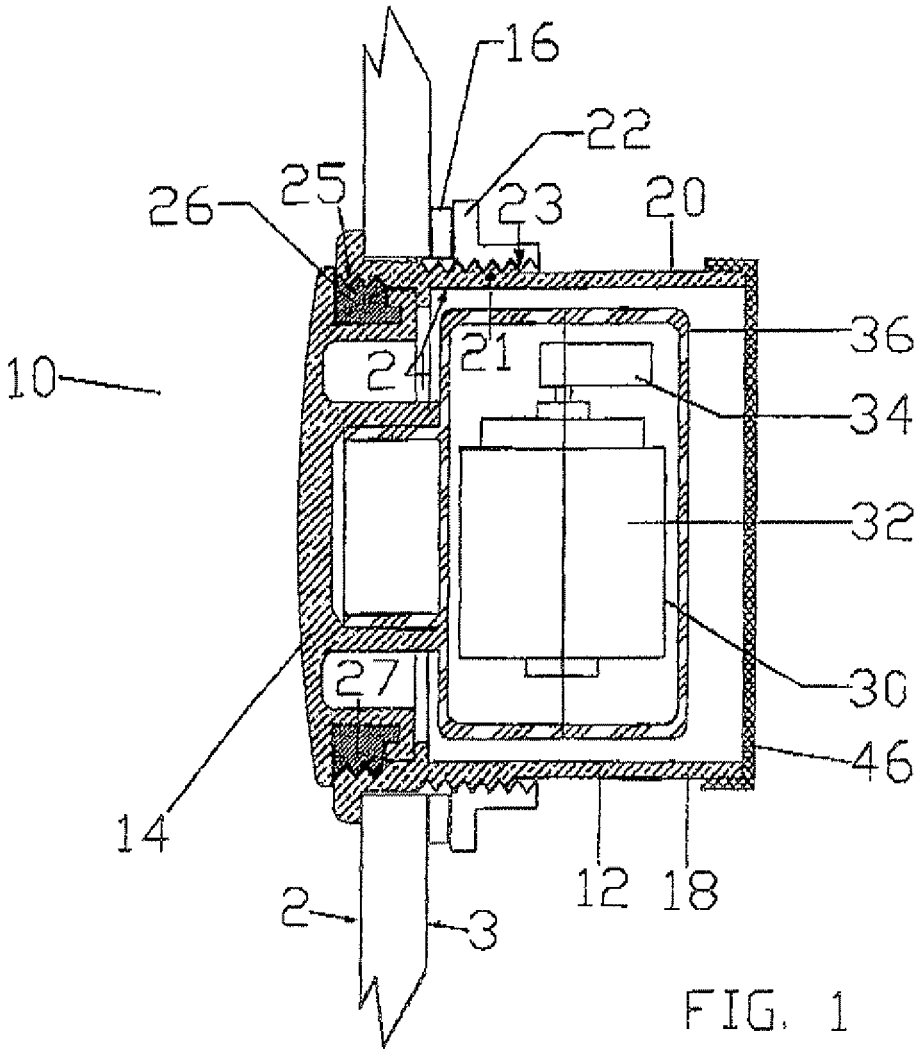
FIG. 1 is a schematic cross sectional view of a massaging device according to a preferred embodiment of the invention.

In the context of the present description, the expression "bath" includes different types of water containers such as, for example, a bath, a hot tub, a spa, a pool, etc. Moreover, although the present invention was primarily designed for use in a bath, as defined above, it could be used for other suitable applications.

Referring now to FIGS. 1 to 9, the massaging device 10 of the invention is to be mounted in a hole of an inner wall 2 of a bath 1, shown in FIGS. 10 to 13. The device 10 has a casing 12 mountable in a watertight manner in the hole. The device 10 also has a flexible member 14 mounted in a watertight manner on the casing 12, the flexible member 14 having a surface accessible to a user in the bath when the massaging device 10 is mounted in the bath. The flexible member 14 is designed to enter in contact with a user seated in the bath, to provide a massage to this user. The device 10 also has an electrically operated vibrator 30 mounted inside the casing 12, for vibrating the flexible member 14.

Preferably, the massaging device 10 also has a watertight joint 16 between the casing 12 and the bath 1, for mounting the casing in the bath. It should be understood that this joint 16 can be made with silicone or the like upon installation of the device. The joint 16 can also be a rubber joint or any equivalent joint. The watertight joint 16 is an element which ensures that there will be no water leaks from the bath. The embodiment of FIGS. 1 and 3 shows a rubber joint 16 while the embodiments of FIGS. 2 and 4 show a gap 17 where silicone or another watertight material can be spread.

Preferably, the flexible member 14 is made of rubber, of flexible PVC or of flexible polymer.

Figure 2:
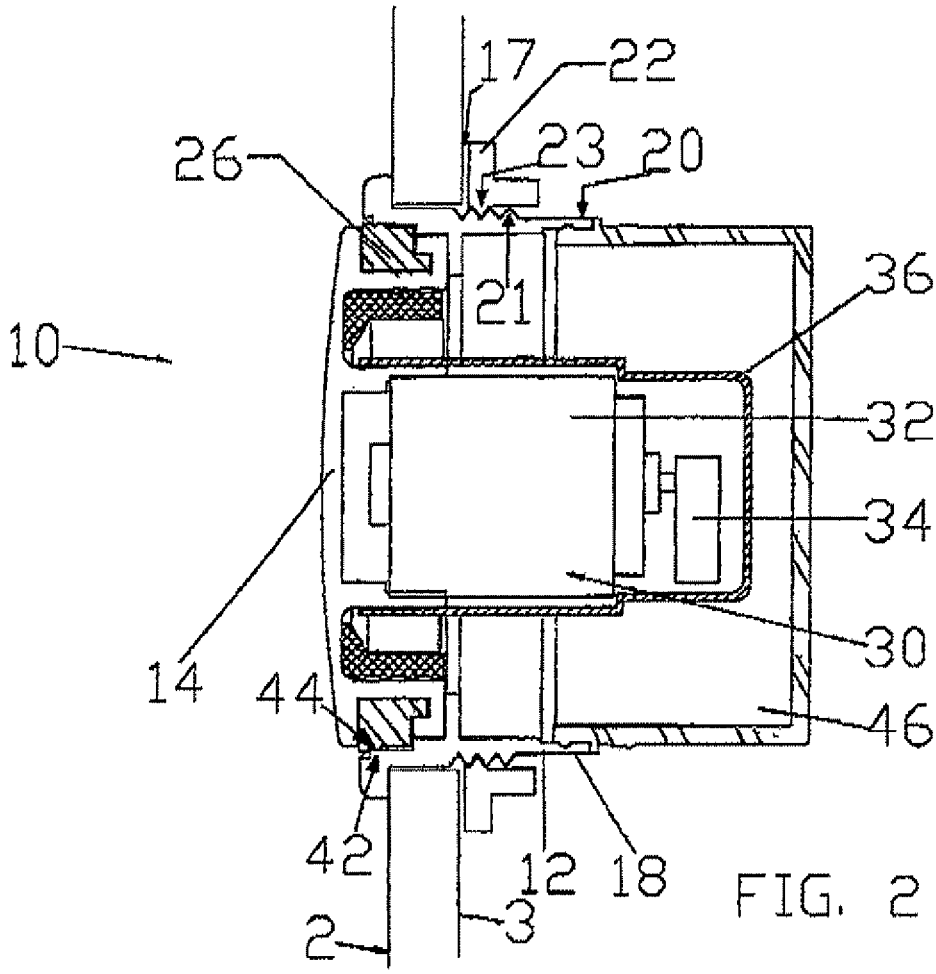
FIG. 2 is a schematic cross sectional view of a massaging device according to another preferred embodiment of the invention.
Figure 3:
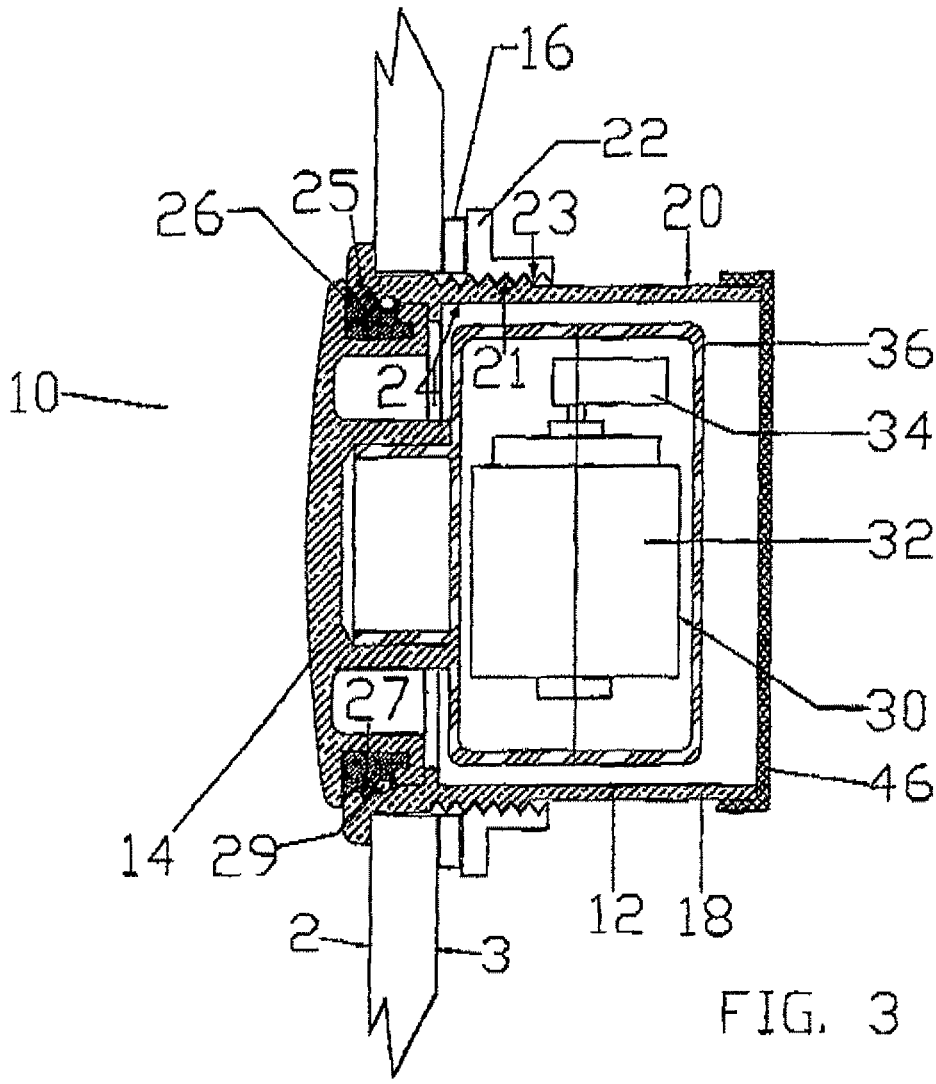
FIG. 3 is a schematic cross sectional view of a massaging device according to another preferred embodiment of the invention.
Figure 4:
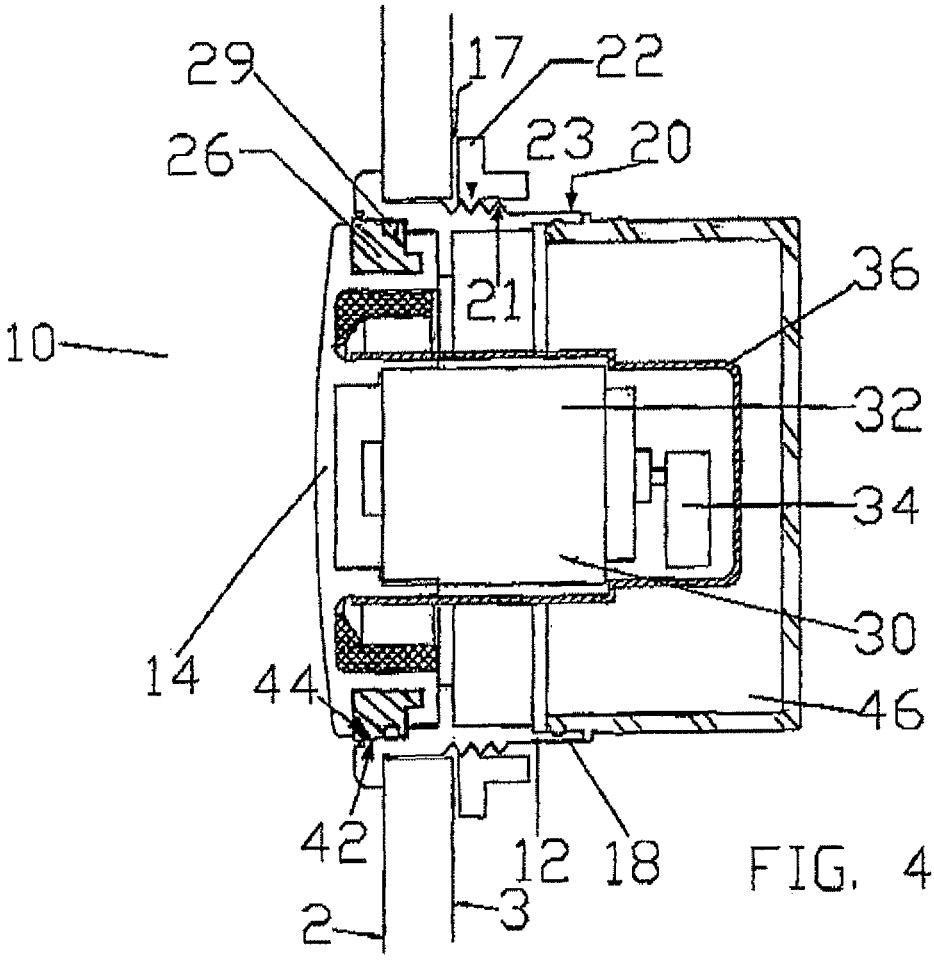
FIG. 4 is a schematic cross sectional view of a massaging device according to another preferred embodiment of the invention.
Figure 5:
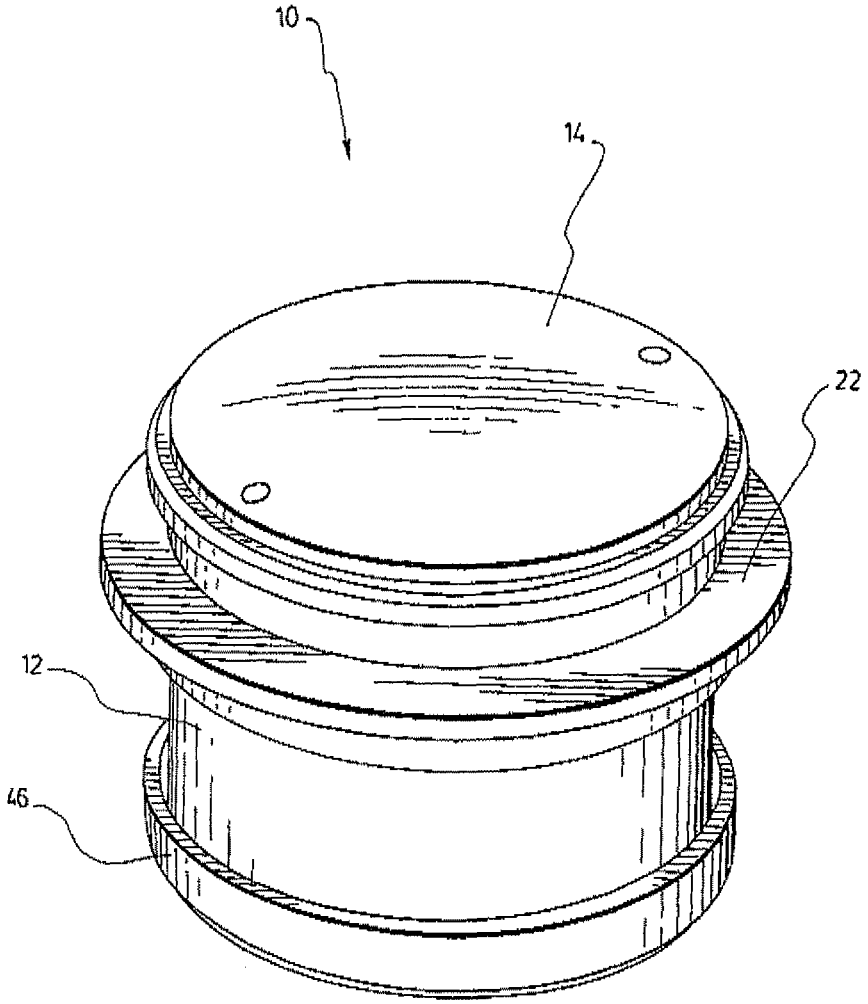
FIG. 5 is a perspective view of a massaging device according to another preferred embodiment of the invention.
Figure 6:
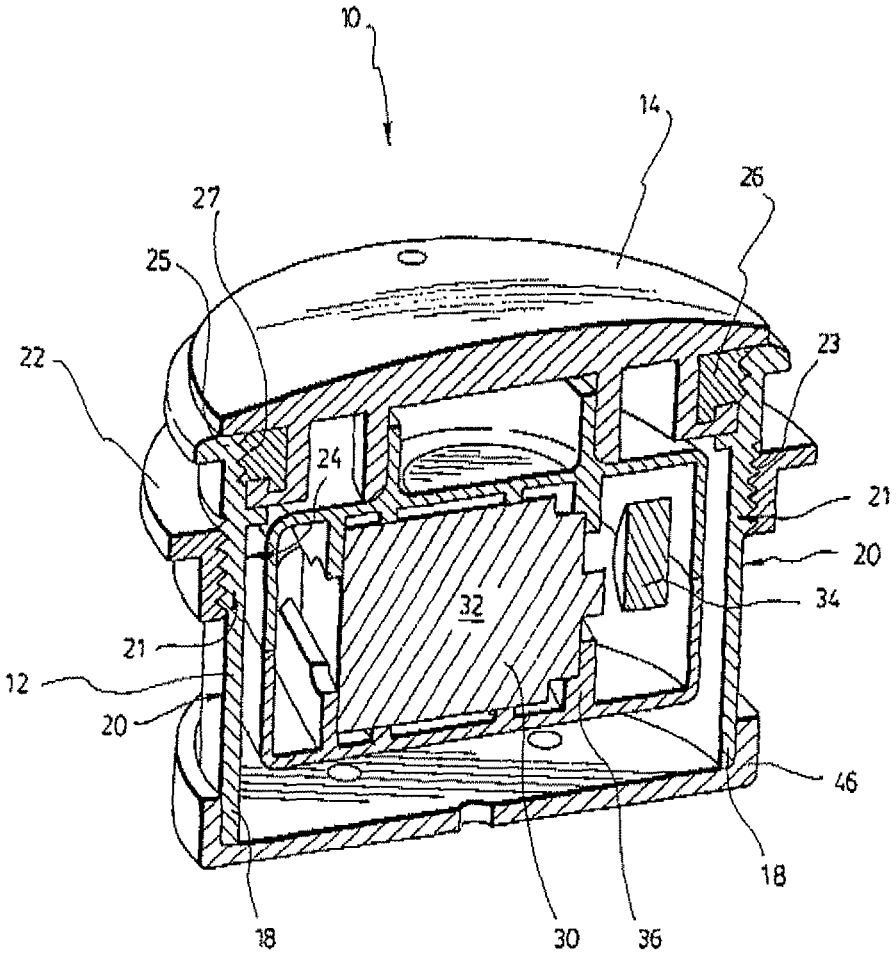
FIG. 6 is a cross sectional perspective view of the massaging device shown in FIG. 5.
Figure 7:
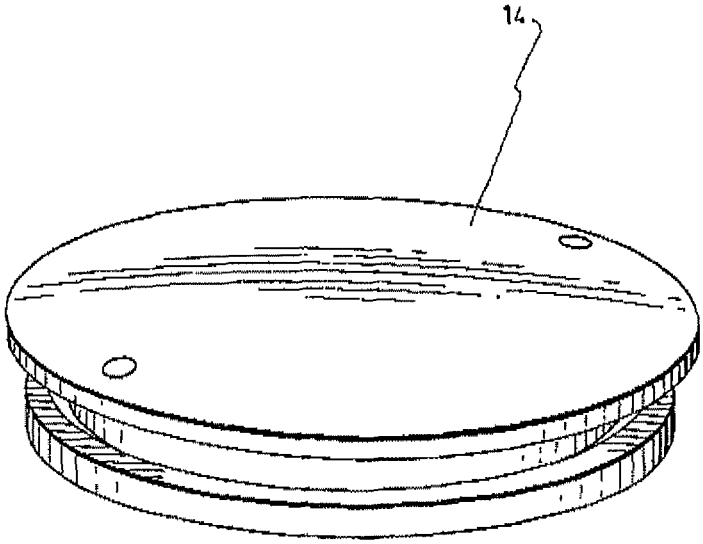
FIG. 7 is a perspective view of the flexible member of the massaging device shown in FIG. 5.
Figure 8:
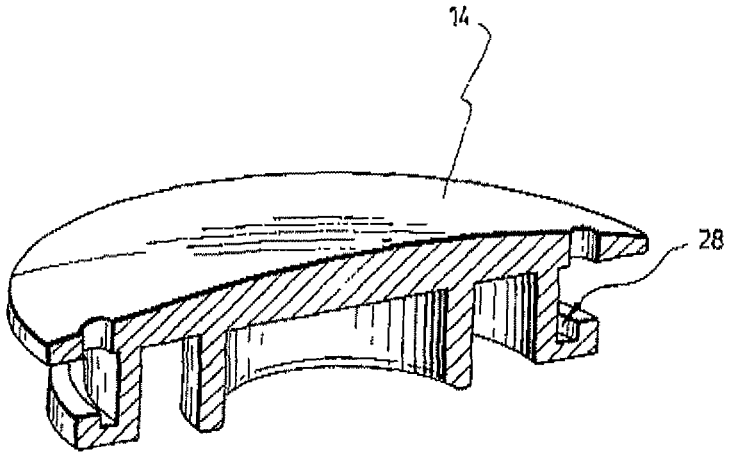
FIG. 8 is a cross sectional perspective view of the flexible member of the massaging device shown in FIG. 7.
Figure 9:
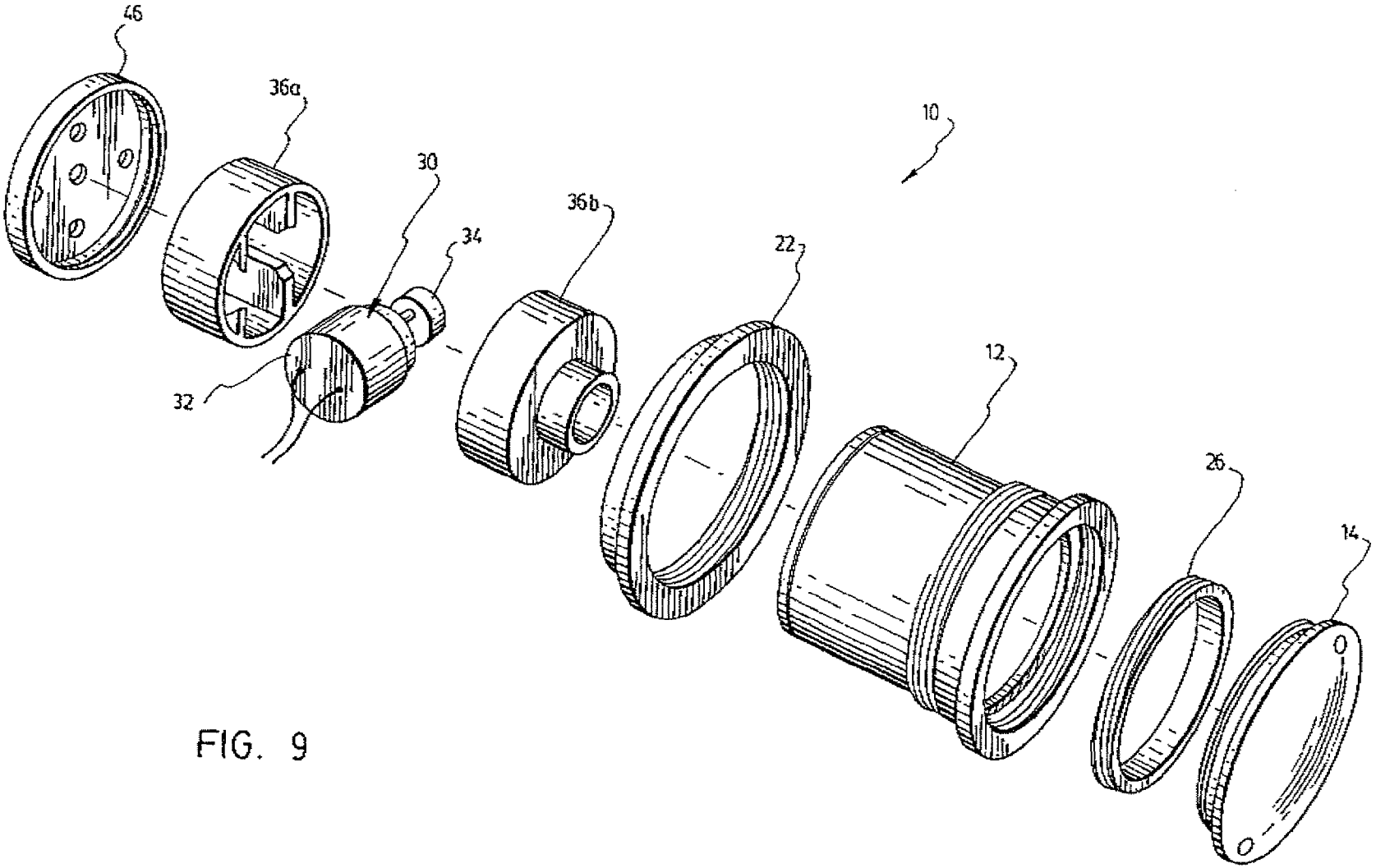
FIG. 9 is an exploded perspective view of the massaging device shown in FIG. 5.
Figure 10:
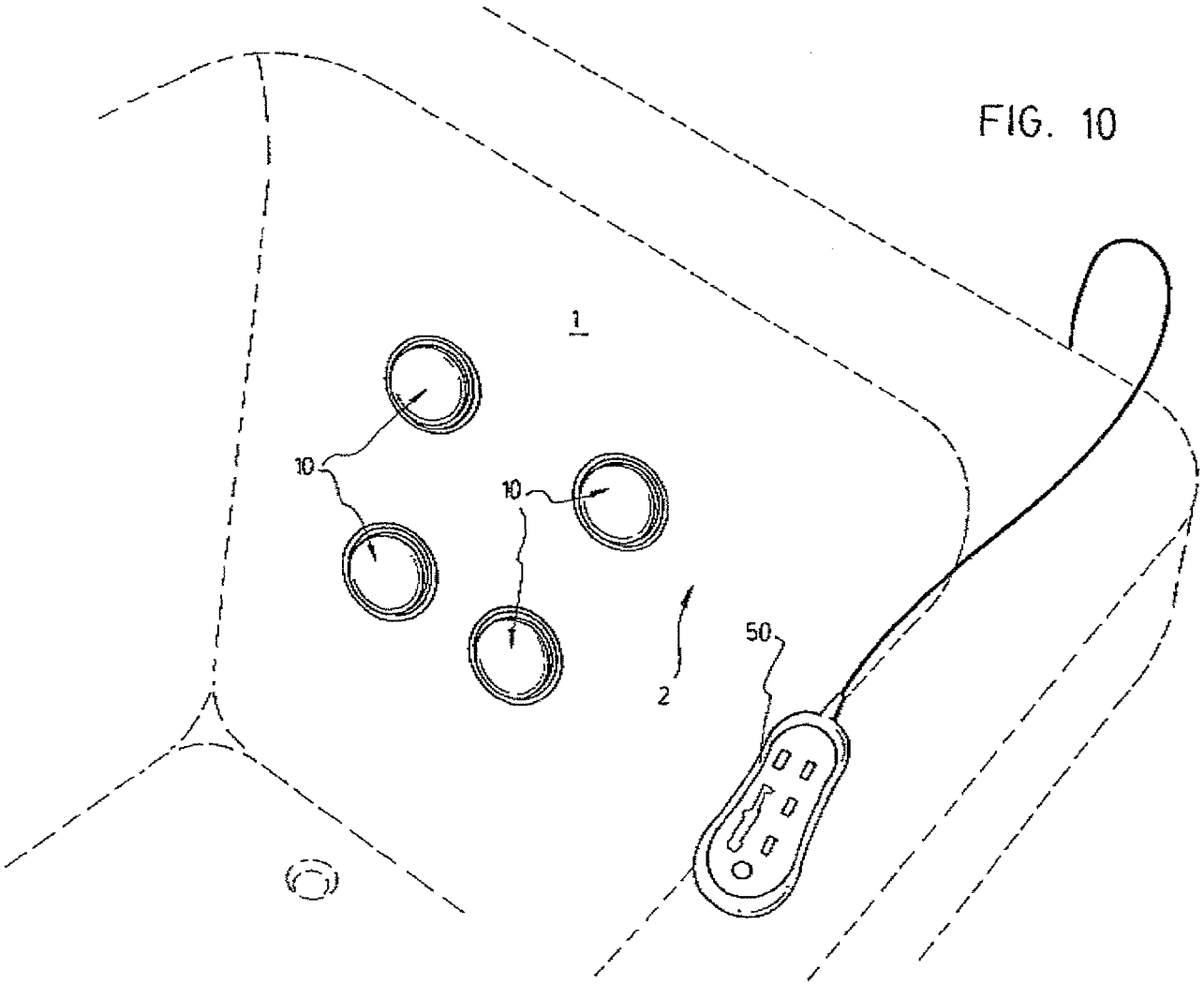
FIG. 10 is a partial front perspective view of a bath, showing a first configuration of massaging devices according to the invention, and a control.
Figure 11:
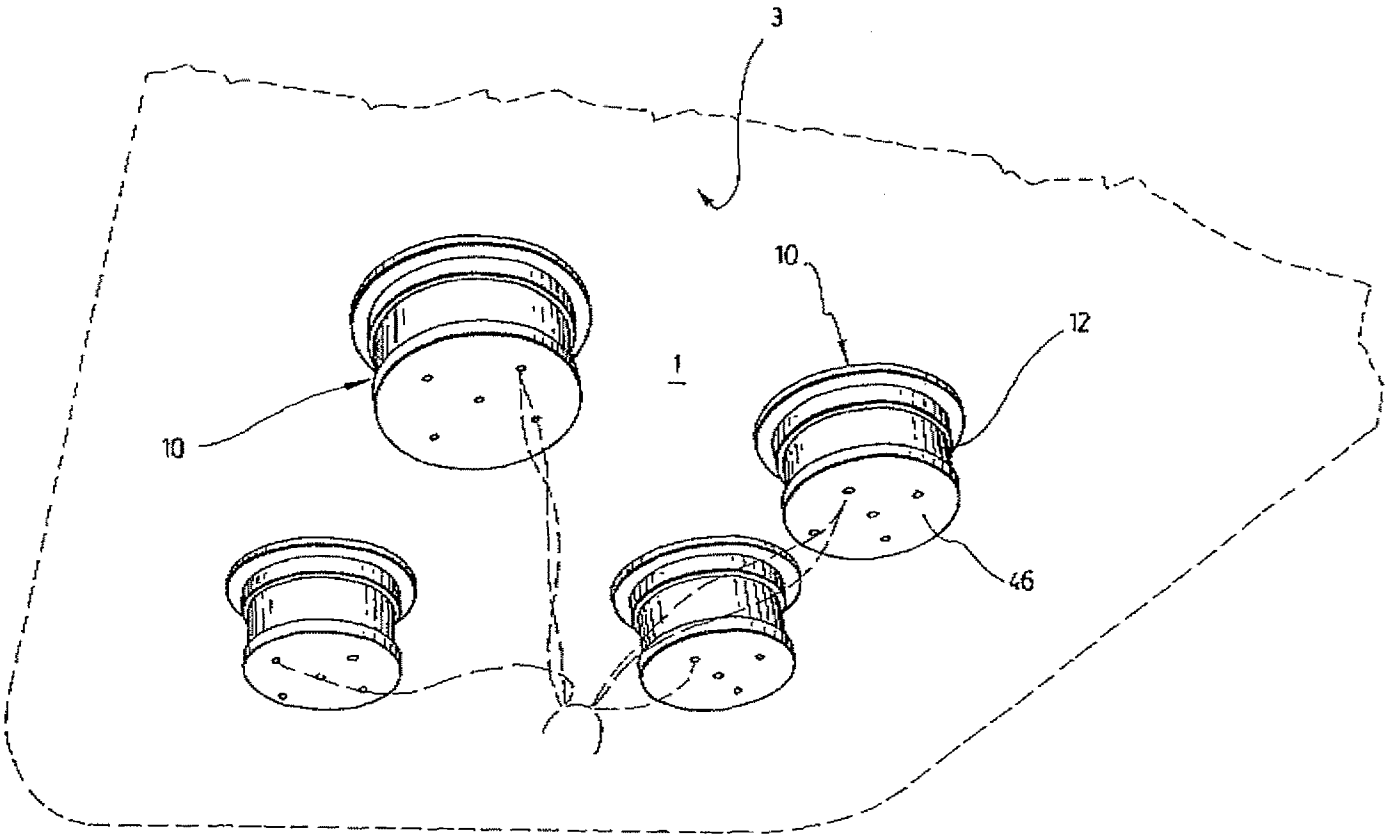
FIG. 11 is a rear perspective view of the bath shown in FIG. 10.
Figure 12:
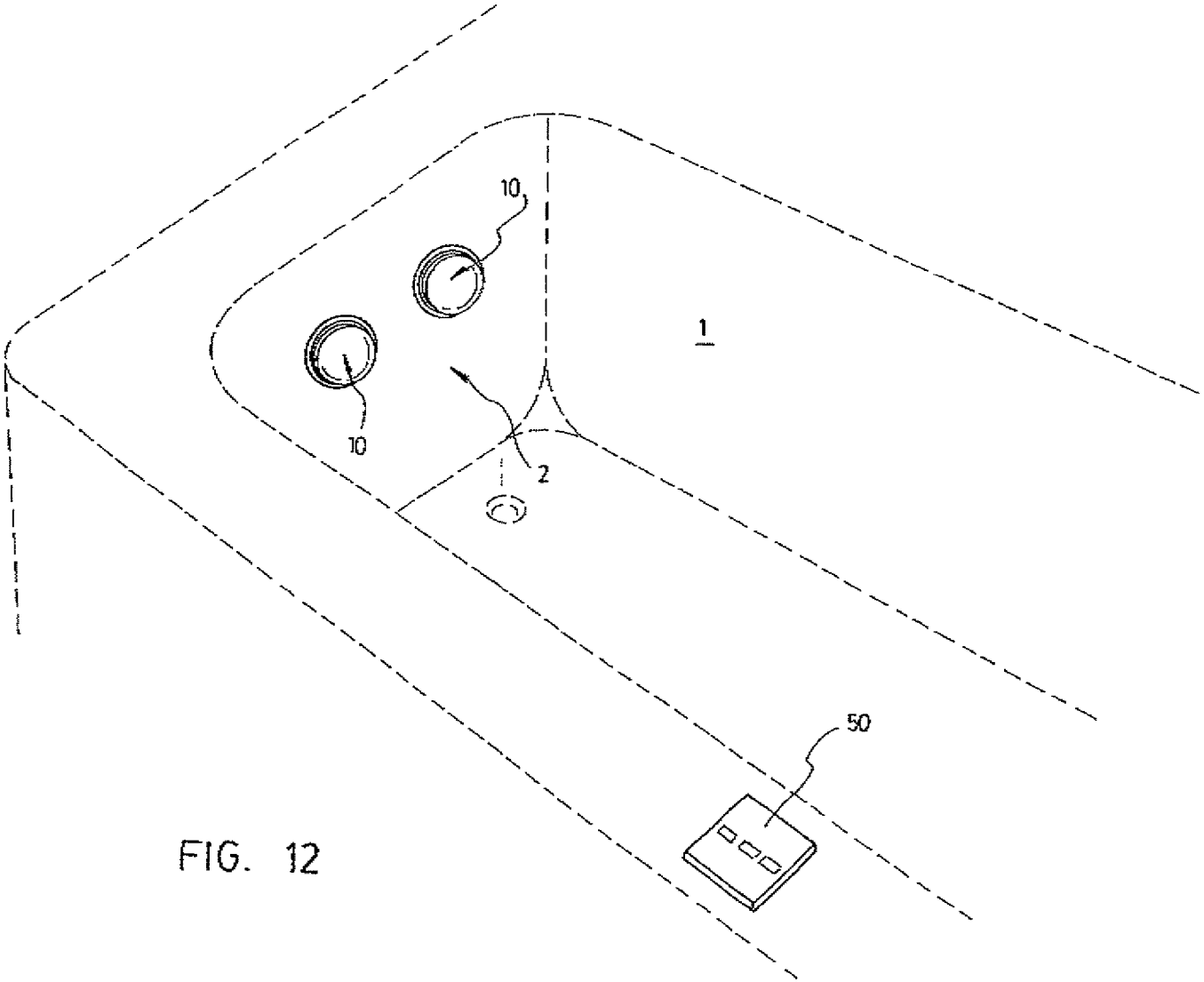
FIG. 12 is a partial front perspective view of another bath, showing a second configuration of massaging devices according to the invention, and a control.
Figure 13:
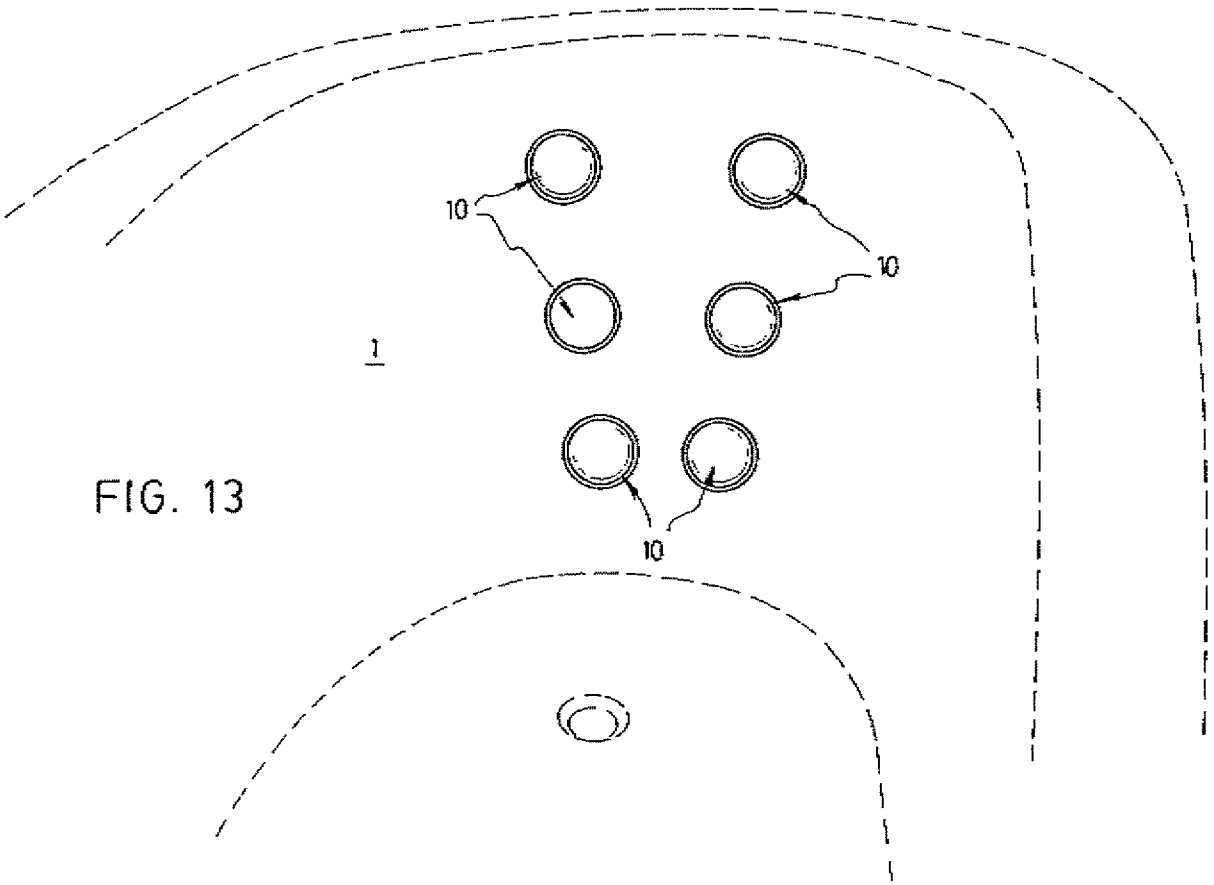
FIG. 13 is a partial front perspective view of another bath, showing a third configuration of massaging devices according to the invention.

Referring now to FIGS. 1 to 4 and 6, the vibrator 30 has a motor 32 and an eccentric mass 34. The motor 32 can be mounted for rotating the eccentric mass 34 around an axis parallel to a surface of the flexible member 14, as shown in FIGS. 1, 3 and 6 to produce a vibration of the flexible member 14. The flexible member 14 is connected to a motor casing 36 for supporting the vibrator 30 in the casing 12 away from walls 18 of the casing. The motor 32 can also be mounted for rotating the eccentric mass 34 around an axis perpendicular to a surface of the flexible member 14, to produce a mechanical rotation of the flexible member 14, as shown in FIGS. 2 and 4. The motor casing 36 is for supporting the vibrator 30 in the casing 12 away from walls 18 of the casing. This configuration of the motor casing 36 supporting the vibrator 30, prevents the vibrations produced by the device 10 to be transmitted to the bath 1, shown in FIGS. 10 to 13. It is mainly the design of the flexible member that prevents the transmission of vibrations from the motor 32 to the entire structure of the bath. The motor casing 36 can be made of two sections 36*a* and 36*b*, as shown in FIG. 9. Other configurations of the flexible member 14 and the motor casing 36 for holding the vibrator 30 could be used without departing from the scope of the invention as claimed. Other dispositions of the vibrator 30, within the casing 12, could also be considered.

Preferably the casing 12 also has an exterior surface 20 having threads 21. It also has a ring element 22 having inner threads 23 capable of cooperating with the threads 21 of the exterior surface 20. The casing 12 is insertable in the hole and the ring element 22 is screwable on the exterior surface 20 of the casing 12, to press the watertight joint 16, 17 against an exterior wall 3 of the bath. Other equivalent means for tightening the casing in the hole could be used, as apparent to an expert in the art.

Referring now to FIGS. 1, 3 and 6, there is shown a first embodiment of the invention, in which the casing 12 preferably has an interior surface 24 having threads 25. The interior surface 24 is closest to the inner wall 2 of the bath when the massaging device 10 is mounted in the bath. The device 10 also has an annular ring 26 having threads 27 capable of cooperating with the threads 25 of the interior surface 24. The flexible member 14 has a first groove 28, better shown in FIG. 8, for receiving the annular ring 26. The annular ring 26 is screwable into the interior surface 24 of the casing 12, thereby mounting the flexible member 14 in a watertight manner on the casing 12. Preferably the massaging device 10 has a watertight O ring 29, as shown in FIG. 3, and the annular ring 26 has a second groove, for receiving and urging the O ring 29 toward the interior surface 24 of the casing 12.

Referring now to FIGS. 2 and 4, there is shown a second embodiment of the invention, in which the casing 12 preferably has an interior surface 24 provided with a recess 42. The interior surface 24 is closest to the inner wall 2 of the bath when the massaging device 10 is mounted in the bath. The device 10 also has an annular ring 26 having a projection 44 capable of cooperating with the recess 42 of the interior surface 24. The flexible member 14 is has a first groove 28 for receiving the annular ring 26. The annular ring 26 is fittable into the interior surface 24 of the casing 12, thereby mounting the flexible member 14 in a watertight manner on the casing 12. Preferably, the massaging device 10 also has a watertight O ring 29, as shown in FIG. 4, and the annular ring 26 has a second groove, for receiving and urging the O ring 29 toward the interior surface 24 of the casing 12.

Referring now to FIG. 9, there is shown an exploded view of an embodiment of the invention. The device 10 of the invention has for advantage that is can be dismounted into its many components. Is has a further advantage that the interior of the casing can be accessed from the interior of the bath, once installed, by unscrewing and removing the flexible member 14 from the interior surface 24 of the casing 12. This provides an access to the interior of the casing, for example for replacing a defective vibrator 30, without dismounting the whole device 10 from the bath 1. It has to be understood that the flexible member 14 could also be interdependent with the casing 12, instead of being screwable to it, without departing from the scope of the invention.

Preferably, the casing 12 also has a back cover 46, for closing a portion of the casing 12, distal from the inner wall of the bath.

Preferably, the parts of the device, such as the casing 12, the back cover 46, etc. can be made of plastic or of any other suitable material. The rings 22, 26 can also be made of plastic but could also be made of metal. Different finish or textures could also be applied to the flexible member 14 or to the casing 12, for enhancing the user experience or for improving the appearance of the device 10 in the bath.

Referring now to FIGS. 10 to 13 there are show different embodiments of a bath massaging system according to the invention. The bath massaging system has at least one massaging device 10 to be mounted in a hole of an inner wall 2 of a bath 1, as described previously.

Preferably, the bath massaging system has a controlling device 50, accessible to the user, for controlling a start, a stop and a speed of the motor 32 of each of the massaging device 10. The controlling device 50 can take many forms and have different controls, as apparent to a person in the art, and is for controlling the speed of the motors 32 of the devices 10. It is thus possible to create pulsations by starting and stopping the motors 32 or by controlling the speed of the motors 32, to obtain different types of massages.

Preferably, the bath massaging system has a plurality of the massaging devices 10 disposed in a square grid, on the inner wall of the bath 1 or can have an even number of massaging devices 10 disposed in groups of two massaging devices 10 side by side, on the inner wall of the bath 1. The bath massaging system can have a multiple of six massaging devices 10 disposed in groups of six massaging devices, as shown on FIG. 13, on the inner wall of the bath 1.

Furthermore, as apparent to a person in the art, different sizes of devices could be used according to the needs and other types of motors and vibrating devices could also be used with this invention. It should be understood that the configuration of the preferred embodiment could also be modified in order to accept other kinds of vibrating devices or motors, for example solenoids or piezoelectric membranes.

The invention claimed is:

1. A massaging device to be mounted in a hole of an inner wall of a bath, the massaging device comprising:

a) a casing mountable in a watertight manner in the hole, the casing comprising an exterior surface having outer threads, and a ring element having inner threads capable of cooperating with the outer threads of the exterior surface of the casing, the casing being insertable in the hole and the ring element bein screwable on the exterior surface of the casing;

b) a flexible member mounted in a watertight manner on the casing, the flexible member having a surface accessible to a user in the bath when the massaging device is mounted in the bath; and c) an electrically operated vibrator located inside the casing and mounted to the flexible member for vibrating the flexible member, the vibrator being supported within the casing only by the flexible member.

2. The massaging device of claim 1, comprising a watertight joint mountable between the casing and the bath, and wherein the ring element is screwable on the exterior surface of the casing to press the watertight joint against an exterior wall of the bath.

3. The massaging device of claim 1, wherein the flexible member is made of rubber, of flexible PVC or of flexible polymer.

4. The massaging device of claim 1, wherein the vibrator comprises a motor and an eccentric mass, the motor being for rotating the eccentric mass around an axis substantially parallel to the surface of the flexible member such as to produce a vibration of the flexible member.

5. The massaging device of claim 1, wherein the vibrator comprises a motor and an eccentric mass, the motor being for rotating the eccentric mass around an axis substantially perpendicular to the surface of the flexible member such as to produce a vibration of the flexible member.

6. The massaging device of claim 1, wherein the casing comprises: an interior surface having inner threads, the interior surface being closest to the inner wall of the bath when the massaging device is mounted in the bath; and an annular ring having threads capable of cooperating with the inner threads of the interior surface, the flexible member comprising a first groove for receiving the annular ring, the annular ring being screwable into the interior surface of the casing, thereby mounting the flexible member in a watertight manner on the casing.

7. The massaging device of claim 6, comprising a watertight O-ring and wherein the annular ring is provided with a second groove, for receiving and urging the O-ring toward the interior surface of the casing.

8. The massaging device of claim 1, wherein the casing comprises: an interior surface provided with a recess, the interior surface being closest to the inner wall of the bath when the massaging device is mounted in the bath; and an annular ring having a projection capable of cooperating with the recess of the interior surface, the flexible member being provided with a first groove for receiving the annular ring, the annular ring being fittable into the interior surface of the casing, thereby mounting the flexible member in a watertight manner on the casing.

9. The massaging device of claim 8, comprising a watertight O-ring and wherein the annular ring is provided with a second groove, for receiving and urging the O-ring toward the interior surface of the casing.

10. The massaging device of claim 1, wherein the casing comprise a back cover, for closing a portion of the casing distal from the inner wall of the bath.

11. The massaging device of claim 1, wherein the vibrator is in contact with the casing only through the flexible member.

12. A bath massaging system comprising at least one massaging device to be mounted in a hole of an inner wall of a bath, the at least one massaging device comprising:

a) a casing mountable in a watertight manner in the hole, the casing comprising an exterior surface having outer threads, and a ring element having inner threads capable of cooperating with the outer threads of the exterior surface of the casing, the casing being insertable in the hole and the ring element being screwable on the exterior surface of the casing;

b) a flexible member mounted in a watertight manner on the casing, the flexible member having a surface accessible to a user in the bath when the massaging device is mounted in the bath; and c) an electrically operated vibrator located inside the casing and being mounted to the flexible member for vibrating the flexible member, the vibrator being supported within the casing only by the flexible member.

13. The bath massaging system of claim 12, comprising a watertight joint mountable between the casing and the bath, and wherein the ring element is screwable on the exterior surface of the casing to press the watertight joint against an exterior wall of the bath.

14. The bath massaging system of claim 12, wherein the flexible member of the at least one massaging device is made of rubber, of flexible PVC or of flexible polymer.

15. The bath massaging system of claim 12, wherein the vibrator of the at least one massaging device comprises a motor and an eccentric mass, the motor being for rotating the eccentric mass around an axis substantially parallel to the surface of the flexible member such as to produce a vibration of the flexible member.

16. The bath massaging system of claim 12, wherein the vibrator of the at least one massaging device comprises a motor and an eccentric mass, the motor being for rotating the eccentric mass around an axis substantially perpendicular to the surface of the flexible member such as to produce a vibration of the flexible member.

17. The bath massaging system of claim 12, wherein the system comprises several of the at least one massaging device.

18. The bath massaging system of any one of claims 15 to 17, further comprising a controlling device, accessible to the user, for controlling a start, a stop and a speed of the vibrator of each of said at least one massaging device.

19. The bath massaging system of claim 17, wherein at least some of the massaging devices are disposed in a square grid on the inner wall of the bath.

20. The bath massaging system of claim 17, wherein at least some of the massaging devices are disposed in groups of two massaging devices side by side on the inner wall of the bath.

21. The bath massaging system of claim 17, wherein at least some of the massaging devices are disposed in groups of six massaging devices on the inner wall of the bath.

22. The bath massaging system of claim 17, wherein the massaging devices are disposed in a square grid on the inner wall of the bath.

23. The bath massaging system of claim 17, wherein the massaging devices are disposed in groups of two massaging devices side by side on the inner wall of the bath.

24. The bath massaging system of claim 17, wherein the massaging devices are disposed in groups of six massaging devices on the inner wall of the bath.

25. The bath massaging system of claim 12, wherein the vibrator of the at least one massaging device is in contact with the casing only through the flexible member.

* * * * *